US009290830B2

(12) United States Patent
Nakamura et al.

(10) Patent No.: US 9,290,830 B2
(45) Date of Patent: Mar. 22, 2016

(54) FERRITIC STAINLESS STEEL

(71) Applicant: JFE STEEL CORPORATION, Tokyo (JP)

(72) Inventors: Tetsuyuki Nakamura, Tokyo (JP); Hiroki Ota, Tokyo (JP); Hiroyuki Ogata, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 0 days.

(21) Appl. No.: 14/350,239

(22) PCT Filed: Oct. 11, 2012

(86) PCT No.: PCT/JP2012/006524
§ 371 (c)(1),
(2) Date: Apr. 7, 2014

(87) PCT Pub. No.: WO2013/054524
PCT Pub. Date: Apr. 18, 2013

(65) Prior Publication Data

US 2014/0241931 A1 Aug. 28, 2014

(30) Foreign Application Priority Data

Oct. 14, 2011 (JP) ..... 2011-226505
Sep. 25, 2012 (JP) ..... 2012-210443

(51) Int. Cl.
*C22C 38/02* (2006.01)
*C22C 38/04* (2006.01)
(Continued)

(52) U.S. Cl.
CPC ..... *C22C 38/002* (2013.01); *C21D 6/002* (2013.01); *C21D 8/0226* (2013.01);
(Continued)

(58) Field of Classification Search
CPC .. C22C 38/001; C22C 38/002; C22C 38/004; C22C 38/005; C22C 38/02; C22C 38/04; C22C 38/06; C22C 38/34; C22C 38/42; C22C 38/44; C22C 38/46; C22C 38/48; C22C 38/50; C22C 38/52; C22C 38/54; C22C 38/58; C21D 6/002; C21D 8/0226; C21D 8/0236; C21D 9/46
USPC ..... 420/38, 40, 41, 61, 63, 68
See application file for complete search history.

(56) References Cited

U.S. PATENT DOCUMENTS 6,458,221 B1 * 10/2002 Ota et al. ..... 420/66
2004/0170518 A1 9/2004 Oku
(Continued)

FOREIGN PATENT DOCUMENTS

EP 1413640 4/2004
EP 1930461 6/2008
(Continued)

OTHER PUBLICATIONS

English translation of JP 2008/138270; Jun. 2008.*
(Continued)

*Primary Examiner* — Helene Klemanski
(74) *Attorney, Agent, or Firm* — RatnerPrestia

(57) ABSTRACT

Provided is a ferritic stainless steel excellent in terms of thermal fatigue resistance, high-temperature fatigue resistance and oxidation resistance without adding Mo or W, which is an expensive chemical element and with controlling Nb content to be as small as possible. The chemical composition contains, by mass %, C: 0.020% or less, Si: 3.0% or less, Mn: 3.0% or less, P: 0.040% or less, S: 0.030% or less, Cr: 10% to 25%, N: 0.020% or less, Nb: 0.005% to 0.15%, Al: 0.20% to 3.0%, Ti: 5×(C %+N %) to 0.5%, Mo: 0.1% or less, W: 0.1% or less, Cu: 0.55% to 2.0%, B: 0.0002% to 0.0050%, Ni: 0.05% to 1.0%, and the balance being Fe and inevitable impurities, where C % and N % in the expression 5×(C %+N %) respectively represent the contents (mass %) of the chemical elements C and N.

6 Claims, 4 Drawing Sheets

(51) Int. Cl.

| | |
|---|---|
| ***C22C 38/06*** | (2006.01) |
| ***C22C 38/34*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/52*** | (2006.01) |
| ***C22C 38/54*** | (2006.01) |
| ***C22C 38/00*** | (2006.01) |
| ***C22C 38/58*** | (2006.01) |
| ***C21D 6/00*** | (2006.01) |
| ***C21D 8/02*** | (2006.01) |
| *C21D 9/46* | (2006.01) |

(52) U.S. Cl.

CPC ..... *C21D 8/0236* (2013.01); *C21D 8/0273* (2013.01); *C22C 38/00* (2013.01); *C22C 38/001* (2013.01); *C22C 38/004* (2013.01); *C22C 38/005* (2013.01); *C22C 38/02* (2013.01); *C22C 38/04* (2013.01); *C22C 38/06* (2013.01); *C22C 38/34* (2013.01); *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *C22C 38/54* (2013.01); *C22C 38/58* (2013.01); *C21D 9/46* (2013.01)

(56) References Cited

U.S. PATENT DOCUMENTS

| | | | | |
|---|---|---|---|---|
| 2008/0138233 | A1* | 6/2008 | Tomita et al. | 420/61 |
| 2010/0122800 | A1 | 5/2010 | Nishida | |
| 2011/0008200 | A1* | 1/2011 | Kato et al. | 420/40 |
| 2011/0123387 | A1* | 5/2011 | Kato et al. | 420/40 |
| 2012/0014830 | A1* | 1/2012 | Hamada et al. | 420/61 |
| 2013/0183190 | A1* | 7/2013 | Nakamura et al. | 420/61 |
| 2014/0241931 | A1 | 8/2014 | Nakamura | |
| 2014/0294658 | A1* | 10/2014 | Nakamura et al. | 420/38 |

FOREIGN PATENT DOCUMENTS

| | | | |
|---|---|---|---|
| EP | 2412837 | | 2/2012 |
| JP | 2004-250761 | A | 9/2004 |
| JP | 2006-117985 | A | 5/2006 |
| JP | 2007-92163 | A | 4/2007 |
| JP | 2008-138270 | A | 6/2008 |
| JP | 2008-144199 | A | 6/2008 |
| JP | 2008-297631 | A | 12/2008 |
| JP | 2009-068113 | A | 4/2009 |
| JP | 2010-248620 | A | 11/2010 |

OTHER PUBLICATIONS

English translation of JP 2009/068113; Apr. 2009.*

International Search Report dated Nov. 6, 2012, application No. PCT/JP2012/006524.

European Search Report mailed May 7, 2015 for European Application No. 12840283.1.

Jaaskelainen, Hannu, "Exhaust System Materials," DieselNet Technology Guide, Mar. 30, 2011, pp. 1-25, retrieved on Apr. 14, 2015 <www.DieselNet.com/tech/diesel/exh/mat.php>.

English translation of JP 2006/117985; May 2006.

Entire patent prosecution history of U.S. Appl. No. 14/351,024, filed Apr. 10, 2014, entitled, "Ferritic Stainless Steel."

International Search Report dated Nov. 6, 2012, application No. PCT/JP2012/006523.

* cited by examiner

FERRITIC STAINLESS STEEL

CROSS REFERENCE TO RELATED APPLICATIONS

This is the U.S. National Phase application of PCT International Application No. PCT/JP2012/006524, filed Oct. 11, 2012, and claims priority to Japanese Patent Application No. 2011-226505, filed Oct. 14, 2011 and JP 2012-210443, filed Sep. 25, 2012, the disclosures of each of these applications being incorporated herein by reference in their entireties for all purposes.

FIELD OF THE INVENTION

The present invention relates to ferritic stainless steel which can be preferably used for the parts of an exhaust system, which are used in a high-temperature environment, such as an exhaust pipe and a catalyst outer cylinder (also called converter case) of an automobile or a motorcycle and an exhaust air duct of a thermal electric power plant.

BACKGROUND OF THE INVENTION

The parts of an exhaust system such as an exhaust manifold, an exhaust pipe, a converter case, and a muffler which are used in the environment of the exhaust system of an automobile are required to be excellent in thermal fatigue resistance, high temperature fatigue resistance, and oxidation resistance (hereinafter, these are collectively referred to as "heat resistance"). For use applications in which heat resistance is required as described above, nowadays, Cr containing steel to which Nb and Si are added such as JFE429EX (containing 15 mass % Cr-0.9 mass % Si-0.4 mass % Nb) (hereinafter, referred to as Nb—Si added steel) is often used. In particular, it is known that Nb significantly increases heat resistance. When Nb is added, however, not only the material cost due to Nb being expensive but also an increase in the manufacturing cost of steel increases. Therefore, it is necessary that steel having high heat resistance be developed under the condition that Nb content is controlled to be as small as possible.

In order to solve this problem, Patent Literature 1 discloses a stainless steel sheet whose heat resistance is increased by utilizing the combined addition of Ti, Cu, and B.

Patent Literature 2 discloses a Cu added stainless steel sheet with excellent formability.

Patent Literature 3 discloses a heat-resistant ferritic stainless steel sheet to which Cu, Ti, and Ni are added.

PATENT LITERATURE

PTL 1: Japanese Unexamined Patent Application Publication No. 2010-248620

PTL 2: Japanese Unexamined Patent Application Publication No. 2008-138270

PTL 3: Japanese Unexamined Patent Application Publication No. 2009-68113

SUMMARY OF THE INVENTION

However, in the case of the technique according to Patent Literature 1, since Cu is added, continuous oxidation resistance is unsatisfactory, and since Ti is added, the adhesiveness of oxide scale is lowered. When continuous oxidation resistance is insufficient, the amount of oxide scale is increased during operation at a high temperature, which results in a decrease in the thickness of the base material, excellent thermal fatigue resistance cannot be achieved. In addition, when the adhesiveness of oxide scale is low, spalling of oxide scale occurs during operation and it may lead so as to adversely affect other parts.

Usually, in order to evaluate the increment of the amount of oxide scale, a continuous oxidation test is carried out to determine a weight gain by oxidation after an isothermal holding at a high temperature, and the result indicates a property called continuous oxidation resistance. In order to evaluate the adhesiveness of oxide scale, a cyclic oxidation test in air is carried out to investigate whether or not spalling of oxide scale occurs after heating and cooling have been repeatedly performed, and the result indicates a property called cyclic oxidation resistance. Hereinafter, "oxidation resistance" means both continuous oxidation resistance and cyclic oxidation resistance.

In the case of the technique according to Patent Literature 2, since Ti is insufficiently added to steel, it causes sensitization, which means that Cr depletion zone form in the vicinity of grain boundaries due to Cr combining with C and N in the steel. When sensitization occurs, since oxidation resistance in a Cr depletion zone is lowered, excellent oxidation resistance of steel is unfortunately achieved.

In the case of the technique according to Patent Literature 3, an example, in which B is added in combination with Cu, Ti, and Ni, is not disclosed. When B is not added, since an effect of decreasing a particle size of ϵ-Cu at its precipitation cannot be realized, excellent thermal fatigue resistance is unfortunately achieved.

In order to solve the problems described above, the present invention provides ferritic stainless steel excellent in thermal fatigue resistance, high temperature fatigue resistance, and oxidation resistance by adding neither Mo nor W, which are expensive chemical elements, controlling Nb content to be as small as possible, adding an appropriate amount of Ni to improves oxidation resistance which is lowered by the addition of Cu and Ti, and further adding Al.

The present inventors diligently conducted investigations in order to prevent oxidation resistance from lowering when Cu and Ti are contained and found that oxidation resistance can be improved by containing an appropriate amount of Ni. Moreover, while it is effective to add Cu for improving thermal fatigue resistance under the condition that heating and cooling are repeatedly performed, it is not significantly effective to add Cu for improving high-temperature fatigue resistance in the condition that the temperature is hold at a constant for a long period. This is because, the particle size of ϵ-Cu is increased in a short time when ϵ-Cu is held for a long time at a temperature range in which ϵ-Cu is precipitated, so that ϵ-Cu may not contribute to strengthening. Although ϵ-Cu may contribute to strengthening by solid solution strengthening when held at a temperature higher than the range in which ϵ-Cu is precipitated, the contribution is small. The present inventors diligently conducted investigations regarding a method for increasing also high-temperature fatigue resistance and found that addition of Al is effective.

Here, "excellent thermal fatigue resistance" mentioned in the present invention specifically means that a material has thermal fatigue lifetime equivalent to or more than that of Nb—Si added steel in a thermal fatigue test in which temperature is repeatedly changed between 800° C. and 100° C. with a restraint ratio of 0.5. "Excellent oxidation resistance" means that breakaway oxidation does not occur (a weight gain by oxidation is less than 50 g/m$^2$) even if the material is held in air at a temperature of 1000° C. for 300 hours and that spalling of oxide scale does not occur even after temperature has been repeatedly changed in air between 1000° C. and 100° C. for 400 cycles.

"Excellent high-temperature fatigue resistance" means that the material has high-temperature fatigue lifetime equivalent to or more than that of Nb—Si added steel when a bending stress of 70 MPa is applied at a temperature of 800° C.

The present invention has been completed on the basis of investigations in addition to the knowledge described above, and the subject matter of the present invention includes the following.

[1] Ferritic stainless steel having a chemical composition containing, by mass %, C: 0.020% or less, Si: 3.0% or less, Mn: 3.0% or less, P: 0.040% or less, S: 0.030% or less, Cr: 10% to 25%, N: 0.020% or less, Nb: 0.005% to 0.15%, Al: 0.20% to 3.0%, Ti: 5×(C %+N %) to 0.5%, Mo: 0.1% or less, W: 0.1% or less, Cu: 0.55% to 2.0%, B: 0.0002% to 0.0050%, Ni: 0.05% to 1.0%, and the balance being Fe and inevitable impurities, where C % and N % in the expression 5×(C %+N %) respectively represent the contents (mass %) of the chemical elements C and N.

[2] The ferritic stainless steel according to item [1], the steel having the chemical composition further containing, by mass %, one or more selected from among REM: 0.001% to 0.08%, Zr: 0.01% to 0.5%, V: 0.01% to 0.5%, and Co: 0.01% to 0.5%.

[3] The ferritic stainless steel according to item [1] or [2], the steel having the chemical composition further containing, by mass %, one or more selected from Ca: 0.0005% to 0.0030% and Mg: 0.0002% to 0.0020%.

According to the present invention, it is possible to provide ferritic stainless steel having thermal fatigue resistance, high temperature fatigue resistance, and oxidation resistance equivalent to or more than those of Nb—Si added steel at a temperature of 800° C. without adding expensive Mo or W and with controlling Nb content to be as small as possible. Therefore, it is significantly effective to use the steel for the parts of the exhaust system of an automobile.

DESCRIPTION OF EMBODIMENTS OF THE INVENTION

Firstly, fundamental experiments which have led to the completion of the present invention will be described with reference to the drawings.

1. Fundamental Experiments

Hereinafter, % used when describing a chemical composition of steels always represents mass %.

Figure 1:
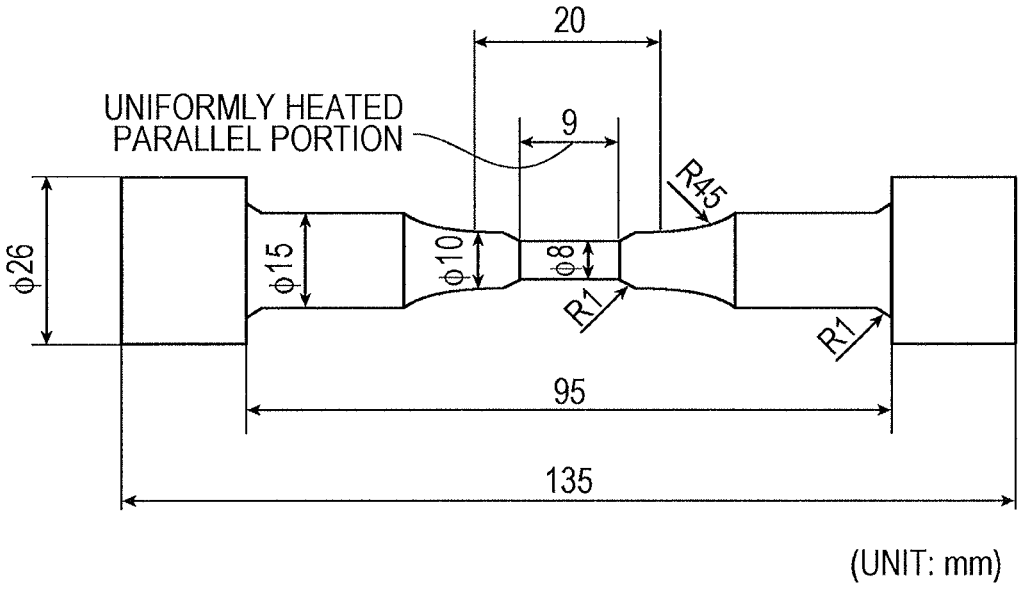
FIG. 1 is a diagram illustrating a thermal fatigue test specimen.

Steels, which were made by adding Cu and Ni in various amounts respectively in the ranges from 0.3% to 3.0% and from 0.03% to 1.3% to a basic steel having a chemical composition containing C: 0.010%, N: 0.012%, Si: 0.5%, Mn: 0.3%, Cr: 14%, Ti: 0.25%, B: 0.0015%, and Al: 0.3%, were smelted at a laboratory level and made into ingots of 30 kg. Each ingot was heated up to a temperature of 1170° C. and hot rolled into a sheet bar having a thickness of 35 mm and a width of 150 mm. This sheet bar was divided into two pieces, and one of the two pieces was made into a square bar having a cross section of 30 mm×30 mm by performing hot forging. The square bar was made into a thermal fatigue test specimen having the dimensions illustrated in FIG. 1 by performing machining after annealing at a temperature in a range from 900° C. to 1000° C. and was used in a thermal fatigue test.

1.1 Thermal Fatigue Test

Figure 2:
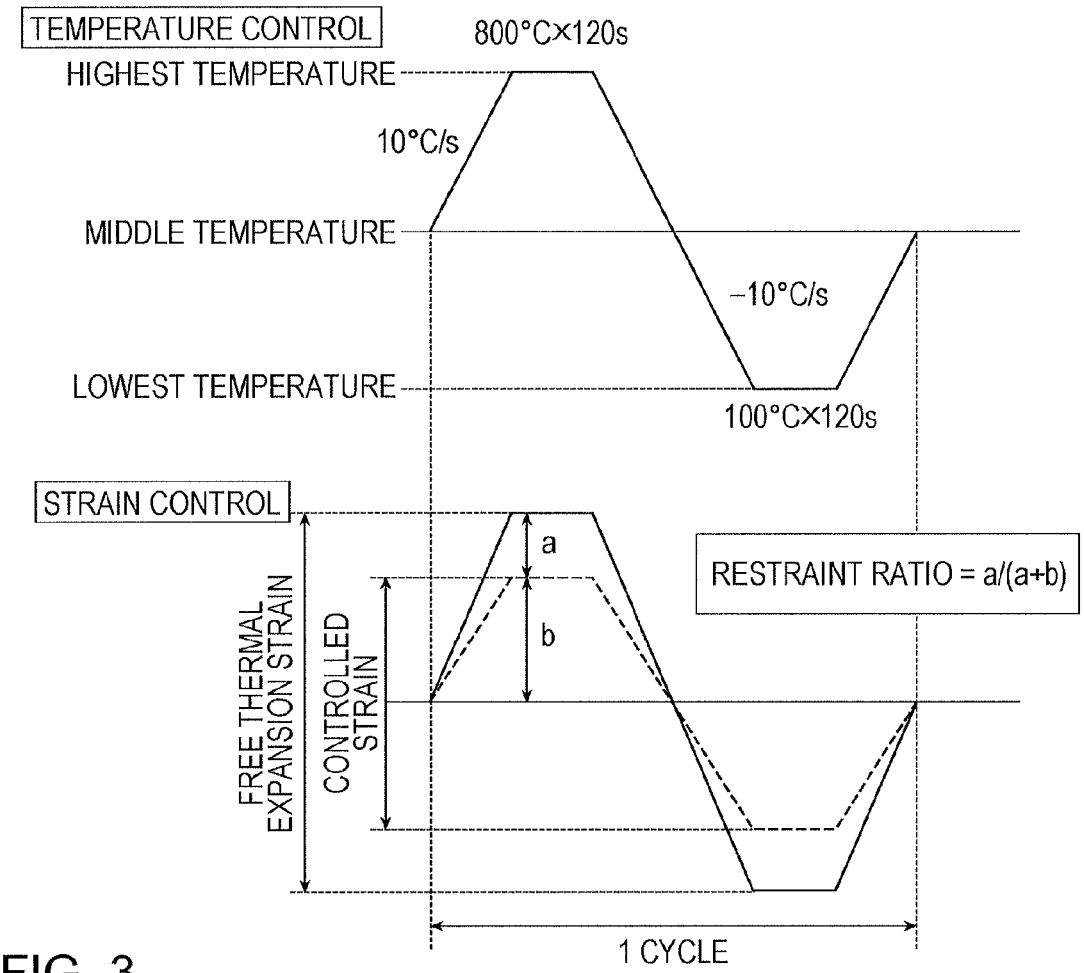
FIG. 2 is a diagram illustrating a temperature and restraint conditions in a thermal fatigue test.

FIG. 2 illustrates the thermal fatigue test method. Thermal fatigue lifetime was determined by repeatedly applying strain to a specimen with a restraint ratio of 0.5 while heating and cooling were repeated between temperatures of 100° C. and 800° C. at a heating rate of 10° C./s and a cooling rate of 10° C./s. Holding periods at the temperatures of 100° C. and 800° C. were both 2 minutes. Here, the thermal fatigue lifetime described above was determined in accordance with the standard published by the Society of Material Science, Japan "Standard for High Temperature Low Cycle Fatigue Testing", in which a stress was calculated by dividing a load detected when the temperature was 100° C. by the cross-sectional area of a uniformity heated parallel portion of the specimen illustrated in FIG. 1, and in which a thermal fatigue lifetime was defined by the cycle number at which the stress was decreased to 75% of that at the 5th cycle. Here, for comparison, the same test was carried out using Nb—Si added steel (15% Cr-0.9% Si-0.4% Nb).

Figure 3:
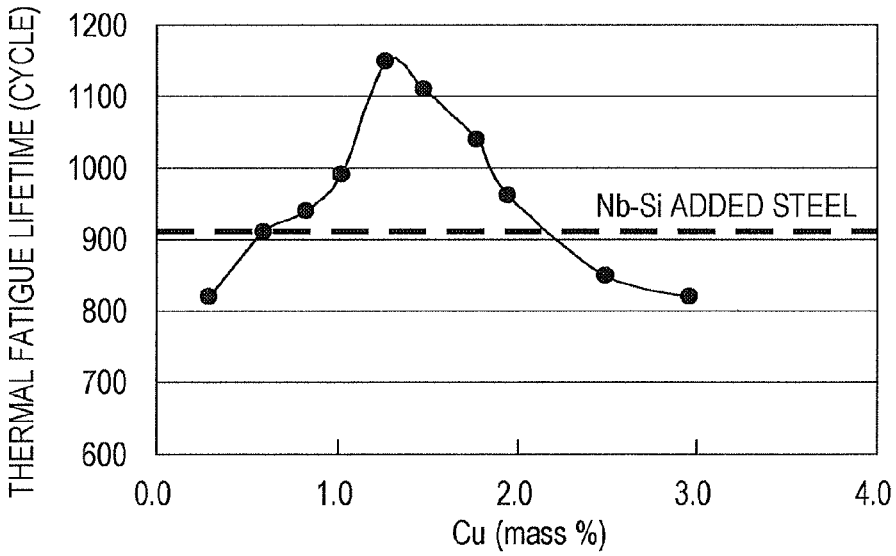
FIG. 3 is a diagram illustrating the influence of Cu content on thermal fatigue resistance (lifetime).

FIG. 3 illustrates the results of the thermal fatigue test. FIG. 3 indicates that, in the case where the Cu content is 0.55% or more and 2.0% or less, a thermal fatigue lifetime equivalent to or more than that of Nb—Si added steel (about 900 cycles) is achieved.

The other one of the two divided sheet bars described above was made into a cold rolled and annealed sheet having a thickness of 2 mm by performing hot rolling, annealing of a hot rolled sheet, cold rolling, and finishing annealing. A specimen of 30 mm×20 mm was cut out of the obtained cold rolled and annealed sheet. An opening of 4 mmϕ was formed in the upper part of the specimen. The surfaces and end faces of the specimen were polished using #320 emery paper and degreased. Then the specimen was used in a continuous oxidation test and a cyclic oxidation test.

1.2 Continuous Oxidation Test

The specimen described above was held in a furnace in atmospheric air at a temperature of 1000° C. for 300 hours, and weight gain par unit area ($g/m^2$) that is caused by oxidation was calculated using the determined difference in the mass of the specimen between before and after the holding. The test was carried out twice for steel, and a case where weight gain per unit area was 50 $g/m^2$ or more at least once was evaluated as a case where breakaway oxidation occurred.

Figure 4:
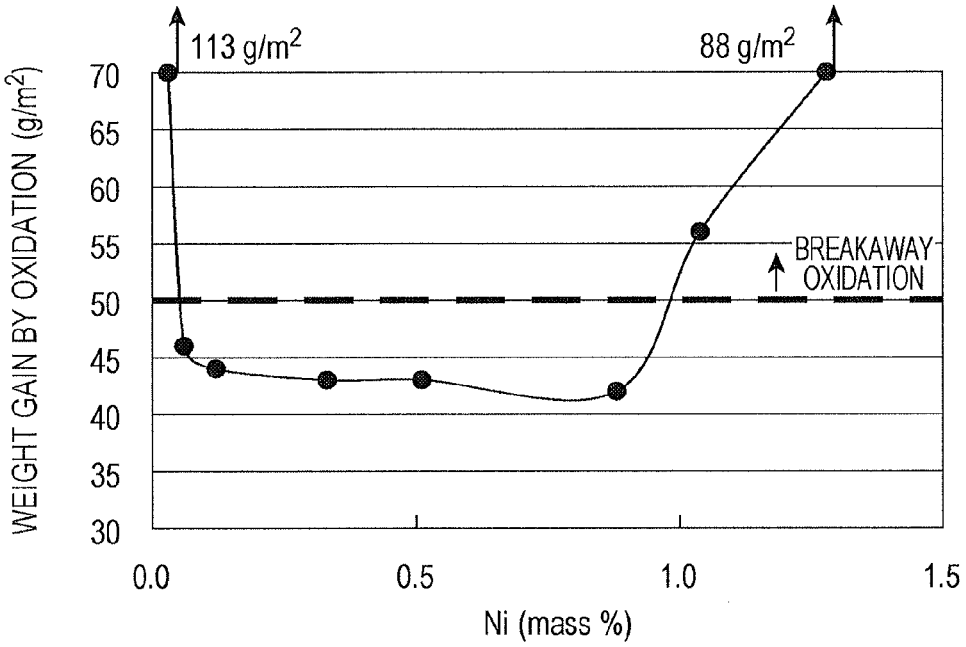
FIG. 4 is a diagram illustrating the influence of Ni content on continuous oxidation resistance (weight gain by oxidation).

FIG. 4 illustrates the influence of Ni content on continuous oxidation resistance. This drawing indicates that, in the case where the Ni content is 0.05% or more and 1.0% or less, the occurrence of breakaway oxidation can be prevented.

1.3 Cyclic Oxidation Test

The specimen described above was subjected to heat treatment, in which heating and cooling were repeated in air under the conditions that the specimen was held at a temperature of 100° C. for 1 minute and at a temperature of 1000° C. for 20 minutes, for 400 cycles. A weight gain per unit area ($g/m^2$) that is caused by oxidation was calculated using the determined difference in the mass of the specimen between before and after the heat treatment, and whether or not spalling of oxide scale from the surface of the specimen occurred was confirmed. A case where significant spalling of oxide scale was observed was evaluated as unsatisfactory, and a case where spalling of oxide scale was not observed was evaluated as satisfactory. Here, in the test described above, the heating rate was 5° C./sec and the cooling rate was 1.5° C./sec.

Figure 5:
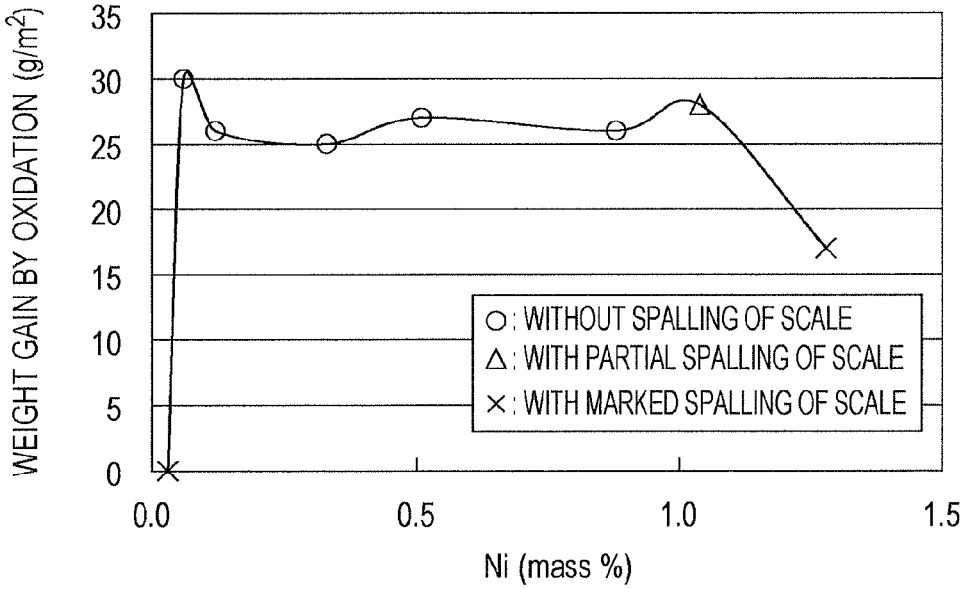
FIG. 5 is a diagram illustrating the influence of Ni content on cyclic oxidation resistance (weight gain by oxidation and whether or not spalling of oxide scale occurs).

FIG. 5 illustrates the influence of Ni on cyclic oxidation resistance. This drawing indicates that, in the case where the Ni content is 0.05% or more and 1.0% or less, spalling of oxide scale can be prevented.

As described above, it is understood that, in order to prevent breakaway oxidation and spalling of oxide scale, it is necessary that the Ni content be 0.05% or more and 1.0% or less.

1.4 High-Temperature Fatigue Test

Steels, which were made by adding Al in various amounts respectively in the ranges from 0.03% to 3.1% to a basic steel having a chemical composition containing, by mass %, C: 0.010%, N: 0.012%, Si: 0.5%, Mn: 0.3%, Cr: 14%, Ti: 0.25%, B: 0.0015%, Cu: 1.4%, and Ni: 0.3%, were experimentally smelted and made into ingots of 30 kg. The ingot was reheated up to a temperature of 1170° C. and hot rolled into a sheet bar of having a thickness of 35 mm and a width of 150 mm. This sheet bar was divided into two pieces, and one of the two pieces was made into a cold rolled and annealed sheet having a thickness of 2 mm through hot rolling, annealing of a hot rolled sheet, cold rolling and finishing annealing processes. A fatigue test specimen having the shape illustrated in FIG. 6 was made from the cold rolled and annealed sheet derived as described above and used in a high-temperature fatigue test as described below.

Using the specimen described above and a Schenck type fatigue testing machine, a bending stress of 70 MPa was applied to the surface of the steel sheet at a speed of 1300 rpm and at a temperature of 800° C. Here, high-temperature fatigue resistance was evaluated on the basis of the cycle number at which the specimen was broken (cycle number for failure).

Figure 7:
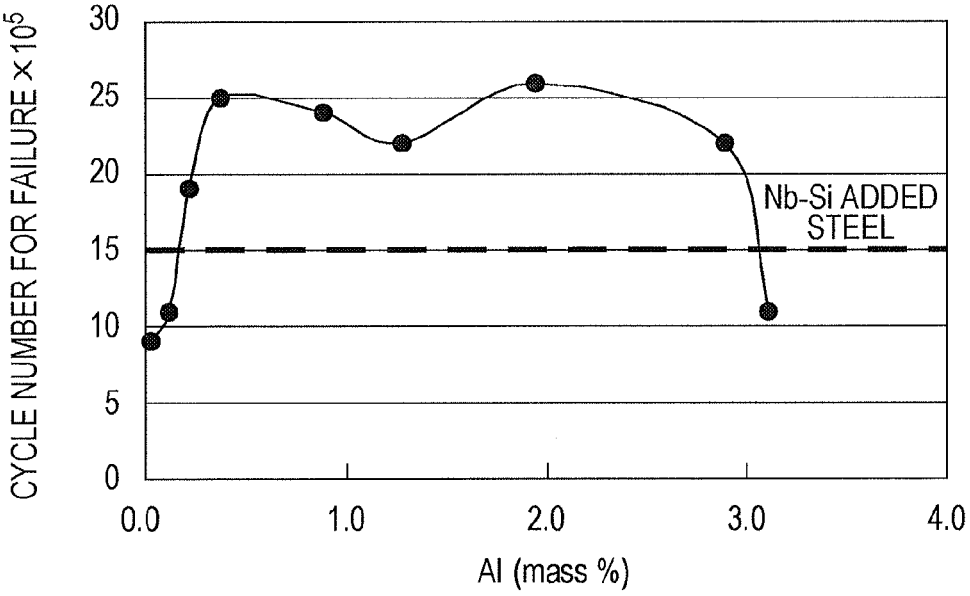
FIG. 7 is a diagram illustrating the influence of Al content on high temperature fatigue resistance (the cycle number at which a fracture occurred).

FIG. 7 is a diagram illustrating the influence of Al on a cycle number for failure (=high-temperature fatigue resistance). This drawing indicates that, in the case where the Al content is 0.2% or more and 3.0% or less, high-temperature fatigue resistance equivalent to or more than that of Nb—Si added steel can be achieved.

2. Chemical Composition

Subsequently, the reason why the chemical composition of the ferritic stainless steel according to the present invention is selected will be described. Here, % used when describing a chemical composition below also always represents mass %.

C: 0.020% or Less

Although C is a chemical element which is effective for increasing the strength of steel, there is a significant decrease in toughness and formability in the case where the C content is more than 0.020%. Therefore, in embodiments of the present invention, the C content is set to be 0.020% or less. Incidentally, since it is preferable that the C content be as small as possible in order to achieve good formability, it is preferable that the C content be 0.015% or less, more preferably 0.010% or less. On the other hand, it is preferable that the C content be 0.001% or more in order to achieve strength for the parts of an exhaust system, more preferably 0.003% or more.

Si: 3.0% or Less

Si is a chemical element which is important for increasing oxidation resistance of steel. This effect is realized in the case where the Si content is 0.1% or more. It is preferable that the Si content be 0.3% or more in the case where better oxidation resistance is required. However, in the case where the Si content is more than 3.0%, there is not only a decrease in formability but also a decrease in adhesiveness of oxide scale. Therefore, the Si content is set to be 3.0% or less, preferably 0.2% or more and 2.0% or less, more preferably 0.3% or more and 1.0% or less.

Mn 3.0% or Less

Mn is a chemical element which increases the strength of steel, which functions as a deoxidizing agent and which suppresses spalling of oxide scale caused by Si addition. It is preferable that the Mn content be 0.1% or more in order to realize these effects. However, in the case where the Mn content is more than 3.0%, there is not only an increase in weight gain by oxidation but also a decrease in heat resistance due to a tendency for a γ phase to be formed at a high temperature. Therefore, the Mn content is set to be 3.0% or less, preferably 0.2% or more and 2.0% or less, more preferably 0.2% or more and 1.0% or less.

P: 0.040% or Less

Since P is a harmful chemical element which decreases toughness of steel, it is preferable that the P content be as small as possible. Therefore, in embodiments of the present invention, the P content is set to be 0.040% or less, preferably 0.030% or less.

S: 0.030% or Less

Since S is an harmful chemical element which decreases elongation and an r value with having a negative influence on formability and which decreases corrosion resistance which is the fundamental property of stainless steel, it is preferable that the S content be as small as possible. Therefore, in embodiments of the present invention, the S content is set to be 0.030% or less, preferably 0.010% or less, more preferably 0.005% or less.

Cr: 10% or More and 25% or Less

Although Cr is an important chemical element which is effective for increasing corrosion resistance and oxidation resistance which characterizes stainless steel, sufficient oxidation resistance cannot be achieved in the case where the Cr content is less than 10%. On the other hand, Cr is a chemical element which increases hardness and decreases ductility by increasing the strength of steel by solid solution strengthening at room temperature. In particular, since, in the case where the Cr content is more than 25%, the negative effects described above are significant, the upper limit of the Cr content is set to be 25%. Therefore, the Cr content is set to be 10% or more and 25% or less, preferably 12% or more and 20% or less, more preferably 14% or more and 16% or less.

N: 0.020% or Less

Since N is a chemical element which decreases toughness and formability of steel, formability of steel decrease significantly in the case where the N content is more than 0.020%. Therefore, the N content is set to be 0.020% or less. Incidentally, since it is preferable that the N content be as small as possible in order to achieve sufficient toughness and formability, it is preferable that the N content be 0.015% or less.

Nb: 0.005% or More and 0.15% or Less

Nb is a chemical element which is effective for increasing corrosion resistance, formability and the intergranular corrosion resistance of a welded part by fixing C and N as a result of forming carbonitrides and which is effective for increasing thermal fatigue resistance and high temperature fatigue resistance by increasing high-temperature strength. In particular, in the present invention, Nb is effective for significantly increasing thermal fatigue resistance and high-temperature fatigue resistance by further decreasing the particle size of ϵ-Cu. It is necessary that the Nb content be 0.005% or more in order to realize these effects. However, there are problems in that Nb is an expensive chemical element and in that contribution to an increase in strength of steel cannot be realized in the case where a Laves phase ($Fe_2Nb$) is formed and the particle size of this phase is increased in a thermal cycles. In addition, since the recrystallization temperature of steel is increased in the case where Nb is added, it is necessary that annealing temperature be high, which results in an increase in manufacturing cost. Therefore, the upper limit of the Nb content is set to be 0.15%. Therefore, the Nb content is set to be 0.005% or more and 0.15% or less, preferably 0.01% or more and 0.15% or less, more preferably 0.02% or more and 0.10% or less.

Mo: 0.1% or Less

Mo is a chemical element which increases heat resistance by significantly increasing the strength of steel by solid solution strengthening. However, since Mo is an expensive chemical element and decreases the oxidation resistance of steel containing Ti, Cu, and Al according to the present invention, Mo is not actively added from the viewpoint of the object of the present invention. However, there is a case where Mo is mixed into steel from materials such as scrap in an amount of 0.1% or less. Therefore, the Mo content is set to be 0.1% or less, preferably 0.05% or less.

W: 0.1% or Less

W is a chemical element which increases heat resistance by significantly increasing the strength of steel by solid solution strengthening as Mo does. However, since W is an expensive chemical element as Mo is, and since W is effective for stabilizing the oxide scale of stainless steel, which results in an increase in workload to remove oxide scale which is formed at annealing, W is not actively added. However, there is a case where W is mixed into steel from materials such as scrap in an amount of 0.1% or less. Therefore, the W content is set to be 0.1% or less, preferably 0.05% or less, more preferably 0.02% or less.

Al: 0.20% or More and 3.0% or Less

Al is well known as a chemical element which is effective for increasing oxidation resistance and high-temperature salt corrosion resistance. In the present invention, Al is advantageous as a chemical element which increases high-temperature fatigue resistance. This effect is realized in the case where the Al content is 0.20% or more. On the other hand, since, in the case where the Al content is more than 3.0%, there is a significant decrease in the toughness of steel, brittle failure tends to occur, which results in good high-temperature fatigue resistance not being achieved. Therefore, the Al content is set to be 0.20% or more and 3.0% or less, preferably 0.30% or more and 1.0% or less. In order to achieve high-temperature fatigue resistance, oxidation resistance and toughness are balanced as well as possible, the Al content is set to be 0.3% or more and 0.6% or less.

Cu: 0.55% or More and 2.0% or Less

Cu is a chemical element which is very effective for increasing thermal fatigue resistance of steel. This is because of the precipitation strengthening effect of ϵ-Cu, and it is necessary that the Cu content be 0.55% or more as FIG. 3 indicates. On the other hand, Cu decreases oxidation resistance and formability, and, since, in the case where the Cu content is more than 2.0%, there is an increase in the particle size of ϵ-Cu, on the contrary, decrease in thermal fatigue resistance. Therefore, the Cu content is set to be 0.55% or more and 2.0% or less, preferably 0.7% or more and 1.6% or less. As described below, there is not a sufficient increase in thermal fatigue resistance by only adding Cu. Since the particle size of ϵ-Cu is decreased by the addition of B in combination with Cu, thermal fatigue resistance of steel is increased.

Ti: 5×(C %+N %) or More and 0.5% or Less

Ti is effective for increasing corrosion resistance, formability and the intergranular corrosion resistance of a welded part by fixing C and N in the same manner as Nb. In the present invention, Ti is an advantageous chemical element for fixing C and N without actively adding Nb. It is necessary that the Ti content be 5×(C %+N %) or more, where C % and N % in the expression 5×(C %+N %) respectively represent the contents (mass %) of the chemical elements C and N. Since, in the case where the Ti content is less than that, C and N cannot be completely fixed, sensitization occurs, which results in a decrease in oxidation resistance. In addition, since Al is combined with N in order to compensate for a shortage of Ti, an effect of increasing high-temperature fatigue resistance by solid solution strengthening through the use of Al, which is important in aspects of the present invention, is not provided. On the other hand, since, in the case where the Ti content is more than 0.5%, there is a decrease in the toughness of steel and the adhesiveness of oxide scale (=cyclic oxidation resistance), the Ti content is set to be 5×(C %+N %) or more and 0.5% or less, preferably 0.15% or more and 0.4% or less, more preferably 0.2% or more and 0.3% or less.

B: 0.0002% or More and 0.0050% or Less

B is an advantageous chemical element in the present invention. B increases formability, in particular secondary working performance. Moreover, B is effective for increasing thermal fatigue resistance of Cu containing steel, because B increase high-temperature strength of steel by decreasing the particle size of ϵ-Cu.

Since, in the case where B is not added, the particle size of ϵ-Cu tends to be increased, a sufficient effect of increasing thermal fatigue resistance by adding Cu cannot be realized. This effect is realized in the case where the B content is 0.0002% or more. On the other hand, in the case where the B content is more than 0.0050%, there is a decrease in the formability and toughness of steel. Therefore, the B content is set to be 0.0002% or more and 0.0050% or less, preferably 0.0005% or more and 0.0030% or less.

Ni: 0.05% or More and 1.0% or Less

Ni is an advantageous chemical element in the present invention. Ni is a chemical element which increases not only the toughness of steel but also oxidation resistance. In order to realize these effects, it is necessary that the Ni content be 0.05% or more. In the case where Ni is not added or in the case where the Ni content is less than that, oxidation resistance decreases due to the addition of Cu and Ti. In the case where oxidation resistance decreases, the thickness of a base material decreases due to an increase in weight gain by oxidation, and good thermal fatigue resistance cannot be achieved because the part in which spalling of oxide scale occurs becomes an origin of a crack. On the other hand, Ni is a chemical element which is expensive and which is very effective for forming a γ phase, where the Ni content is more than 1.0%. When the Ni content is more than 1.0%, oxidation resistance is deteriorated because of formation of γ phase at high temperature. Therefore, the Ni content is set to be 0.05% or more and 1.0% or less, preferably 0.08% or more and 0.5% or less, more preferably 0.15% or more and 0.3% or less.

The basic chemical composition according to embodiments of the present invention is as described above. Moreover, one or more selected elements from among REM, Zr, V, and Co may be contained as selective chemical elements in the amounts described below in order to increase heat resistance.

REM: 0.001 or more and 0.08% or less and Zr: 0.01% or more and 0.5% or less

REM (Rare Earth Metals) and Zr are both chemical elements which increase oxidation resistance of steel and which are optionally added as needed in the present invention. In order to realize this effect, it is preferable that the REM content be 0.001% or more and that the Zr content be 0.01% or more. However, there is the embrittlement of steel in the case where the REM content is more than 0.08%, and there is the embrittlement of steel due to the precipitation of intermetallic compounds containing Zr in the case where the Zr content is more than 0.5%. Therefore, it is preferable that the REM content is 0.001% or more and 0.08% or less in the case where REM is contained and that the Zr content be 0.01% or more and 0.5% or less in the case where Zr is contained.

V: 0.01% or More and 0.5% or Less

V is a chemical element which is effective for increasing not only oxidation resistance but also high-temperature strength of steel. In order to realize these effects, it is preferable that the V content be 0.01% or more. However, in the case where the V content is more than 0.5%, toughness of steel decreases due to the precipitation of V(C, N) having a large particle size. Therefore, in the case where V is contained, it is preferable that the V content be 0.01% or more and 0.5% or less, more preferably 0.03% or more and 0.4% or less, furthermore preferably 0.05% or more and 0.25% or less.

Co: 0.01% or More and 0.5% or Less

Co is a chemical element which is effective for increasing toughness and high-temperature strength of steel. In order to realize these effects, it is preferable that the Co content be 0.01% or more. However, Co is an expensive chemical element and the effects described above become saturated even in the case where the Co content is more than 0.5%. Therefore, in the case where Co is contained, it is preferable that the Co content be 0.01% or more and 0.5% or less, more preferably 0.02% or more and 0.2% or less.

Moreover, one or two elements selected from Ca and Mg may be contained as selective chemical elements in the amount described below in order to increase manufacturability.

Ca: 0.0005% or More and 0.0030% or Less

Ca is a chemical element which is effective for preventing the nozzles of continuous casting from choking with the precipitation of inclusions containing Ti. This effect is realized in the case where the Ca content is 0.0005% or more. However, it is necessary that the Ca content be 0.0030% or less in order to achieve good surface quality by preventing the occurrence of surface defects. Therefore, in the case where Ca is contained, it is preferable that the Ca content be 0.0005% or more and 0.0030% or less, more preferably 0.0005% or more and 0.0020% or less, furthermore preferably 0.0005% or more and 0.0015% or less.

Mg: 0.0002% or More and 0.0020% or Less

Mg is a chemical element which is effective for increasing formability and toughness as a result of increasing an equiaxial crystal ratio and which is also effective for suppressing an increase in the particle size of the carbonitride of Ti in the case of Ti added steel according to the present invention. These effects are realized in the case where the Mg content is 0.0002% or more. Since, in the case where there is an increase in the particle size of the carbonitride of Ti, the carbonitride becomes an origin of a brittle fracture, there is a significant decrease in the toughness of steel. On the other hand, in the case where the Mg content is more than 0.0020%, there is the deterioration of the surface quality of steel. Therefore, in the case where Mg is contained, it is preferable that the Mg content be 0.0002% or more and 0.0020% or less, more preferably 0.0002% or more and 0.0015% or less, furthermore preferably 0.0004% or more and 0.0010% or less.

3. Method for Manufacturing

Subsequently, a method for manufacturing the ferritic stainless steel according to embodiments of the present invention will be described hereafter.

A common method for manufacturing ferritic stainless steel can be ideally used for manufacturing the stainless steel according to the present invention, and there is no particular limitation on a method. For example, steel having the chemical composition according to the present invention is made by performing smelting using a melting furnace such as a steel converter or an electric furnace, optionally by further performing secondary refining using a method such as ladle refining or vacuum refining. Subsequently, it is preferable that a slab be made using a continuous casting method or an ingot casting-blooming rolling method and that a cold rolled and annealed sheet be made by performing hot rolling, annealing of hot rolled sheet, pickling, cold rolling, finishing annealing and pickling on the slab.

Incidentally, the cold rolling described above may be performed once, twice or more with process annealing being performed between the performances of cold rolling. In addition, processes of cold rolling, finishing annealing and pickling may be repeatedly performed. Moreover, annealing of hot rolled sheet may be omitted in some cases, and skin pass rolling may be performed after cold rolling or finishing annealing has been performed in the case where the lustrous quality of the surface of a steel sheet is required.

It is more preferable that some of the conditions of hot rolling and cold rolling processes be limited. Regarding a steel making process, it is preferable that secondary refining is performed using a VOD method (Vacuum Oxygen Decarburization method) on the molten steel having the indispensable chemical composition described above and containing additional chemical elements as needed which has been smelted using a steel converter or an electric furnace. Although the smelted molten steel may be made into a steel material using a well-known method, it is preferable that a continuous casting method be used from the viewpoint of productivity and material quality.

The steel material made by performing continuous casting is heated up to a temperature of, for example, 1000° C. to 1250° C., and is hot rolled into a hot rolled sheet having a desired thickness. It is needless to say that the steel material may be processed into a material other than a sheet. This hot rolled sheet is, as needed, subjected to batch annealing at a temperature of 600° C. to 900° C. or to continuous annealing at a temperature of 900° C. to 1100° C. and then made into a hot rolled sheet product by performing, for example, pickling. In addition, descaling may be performed as needed by using a shot blasting method before pickling is performed.

Moreover, in order to obtain a cold rolled and annealed sheet, the hot rolled and annealed sheet is made into a cold rolled sheet through a cold rolling process. In this cold rolling process, cold rolling may be performed twice or more as needed with process annealing for manufacturing reasons. The total rolling reduction ratio of a cold rolling process consisting of cold rolling performed for once, twice or more, is set to be 60% or more, preferably 70% or more.

The cold rolled sheet is made into a cold rolled and annealed sheet by performing continuous annealing (finishing annealing) at a temperature of 850° C. to 1150° C., preferably 850° C. to 1050° C., and then by performing pickling. In addition, the pickled sheet may be subjected to rolling with a small rolling reduction ratio (such as skin pass rolling) in order to control the shape and quality of the steel sheet for some use applications.

The hot rolled sheet product or the cold rolled and annealed sheet product made as described above is formed into an exhaust pipe of an automobile or a motorcycle, a material to be used for a catalyst outer cylinder, an exhaust air duct of a thermal electric power plant or a material related to a fuel cell such as a separator, an interconnector or a reformer by performing processing such as bending forming depending on use applications.

There is no limitation on a method for welding these materials, and an arc welding method such as MIG (Metal Inert Gas), MAG (Metal Active Gas) or TIG (Tungsten Inert Gas), a resistance welding such as spot welding or seam welding, a high frequency resistance welding such as an electric resistance welding method or a high frequency induction welding may be applied.

Example 1

Steels Nos. 1 to 23 and 27 to 40 having the chemical compositions given in Table 1 were smelted using a vacuum melting furnace, and made into ingots of 30 kg by performing casting. The ingot was made into a sheet bar having a thickness of 35 mm and a width of 150 mm by performing heating up to a temperature of 1170° C. and by performing hot rolling. This sheet bar was divided into two pieces, and one of the two pieces was made into a square bar having a cross section of 30 mm×30 mm by performing forging. The square bar was made into a thermal fatigue test specimen having the dimensions illustrated in FIG. 1 by performing annealing at a temperature in a range from 850° C. to 1050° C. and by performing machining and was then used in a thermal fatigue test described below. An annealing temperature was controlled to be a certain temperature in the range described above depending on a chemical composition, with confirming a microstructure. An annealing temperature described below was also controlled similarly.

Thermal Fatigue Test

Thermal fatigue lifetime was determined by repeatedly applying strain to the specimen described above with a restraint ratio of 0.5 as illustrated in FIG. 2 while heating and cooling were repeated between temperatures of 100° C. and 800° C. Holding times at the temperatures of 100° C. and 800° C. were both 2 minutes. Here, the thermal fatigue lifetime described above was determined in accordance with the standard published by the Society of Material Science, Japan "Standard for High Temperature Low Cycle Fatigue Testing", in which a stress was calculated by dividing a load detected when the temperature was 100° C. by the cross-sectional area of the parallel portion of the specimen illustrated in FIG. 1, and in which a thermal fatigue lifetime was defined as the cycle number at which the stress was decreased to 75% of that at the initial stage. Here, for comparison, the same test was carried out using Nb—Si added steel (15% Cr-0.9% Si-0.4% Nb).

The other one of the two divided sheet bar described above was made into a hot rolled sheet having a thickness of 5 mm by heating the piece up to a temperature of 1050° C. and by performing hot rolling. The hot rolled sheet was made into a cold rolled sheet having a thickness of 2 mm by performing annealing of hot rolled sheet at a temperature in a range from 900° C. to 1050° C., by performing pickling, by performing cold rolling and by performing finishing annealing at a temperature in a range from 850° C. to 1050° C. Here, for reference, a cold rolled and annealed sheet was made using Nb—Si added steel (No. 27 in Table 1) in the same manner as described above and used in evaluation tests.

Continuous Oxidation Test

A specimen of 30 mm×20 mm was cut out of each of the various cold rolled and annealed sheets obtained as described above. An opening of 4 mmϕ was formed in the upper part of the specimen. The surfaces and end faces of the specimen were polished using #320 emery paper and degreased. Then the specimen was held in a furnace in the atmospheric air at a temperature of 1000° C. for 300 hours. After the holding, the mass of the specimen was measured and a weight gain by oxidation ($g/m^2$) was calculated from the difference between the mass and that measured in advance before the holding. Here, the test was repeated twice, and the oxidation resistance of the steel was evaluated on the basis of the larger value of the two. A case of a weight gain by oxidation of 50 $g/m^2$ or more was evaluated as the case of breakaway oxidation.

Cyclic Oxidation Test

The specimen described above was subjected to heat treatment, in which heating and cooling were repeated under the conditions that the specimen was held at a temperature of 100° C. for 1 minute and at a temperature of 1000° C. for 20 minutes, was repeated for 400 cycles. A weight gain per unit area ($g/m^2$) that is caused by oxidation was calculated using the determined difference in the mass of the specimen between before and after the heat treatment, and whether or not spalling of scale from the surface of the specimen occurred was confirmed. A case where spalling of oxide scale was markedly observed was evaluated as unsatisfactory, and a case where spalling of oxide scale was not observed was evaluated as satisfactory. Here, in the test described above, a heating rate was 5° C./sec and a cooling rate was 1.5° C./sec.

High-Temperature Fatigue Test

Figure 6:
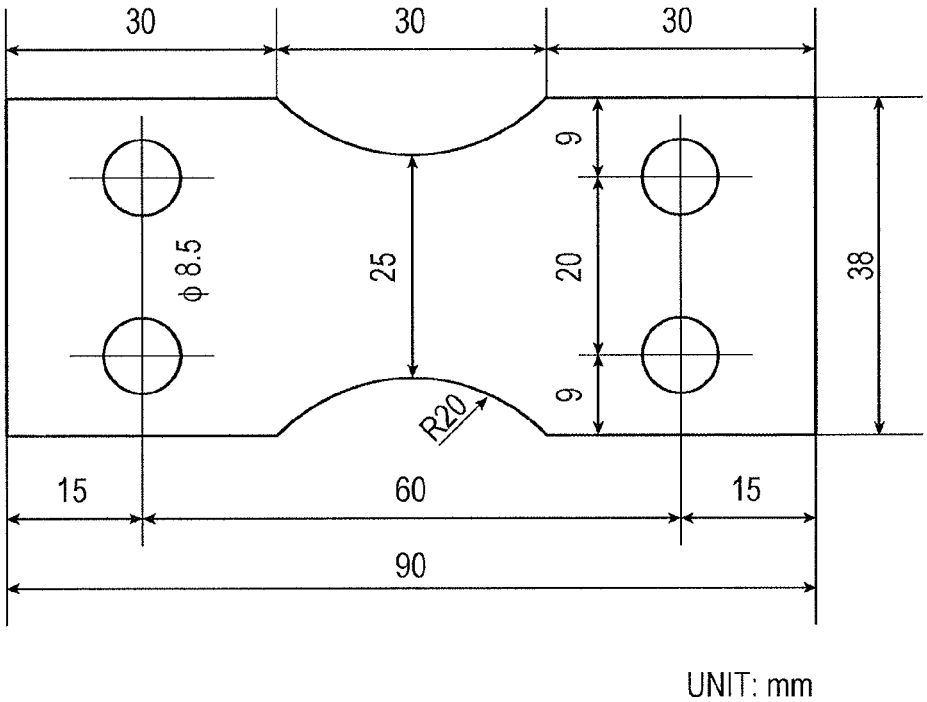
FIG. 6 is a diagram illustrating a high-temperature fatigue test specimen.

A fatigue test specimen having the shape illustrated in FIG. 6 was made from the cold rolled and annealed sheet derived as described above and used in a high-temperature fatigue test as described below.

Using a Schenck type fatigue testing machine, a bending stress of 70 MPa was applied to the surface of the steel sheet at a speed of 1300 rpm and at a temperature of 800° C. Here, high-temperature fatigue resistance was evaluated on the basis of the cycle number at which the specimen was broken (cycle number for failure).

The obtained results are given in Tables 1-1 and 1-2.

TABLE 1-1

| | Chemical Composition (mass %)* | | | | | | | | | | | | |
|---|---|---|---|---|---|---|---|---|---|---|---|---|---|
| NO. | C | Si | Mn | Al | P | S | Cr | Ni | Cu | Nb | V | N | Zr |
| 1 | 0.010 | 0.51 | 0.33 | 0.29 | 0.03 | 0.002 | 14.2 | 0.14 | 1.24 | 0.04 | — | 0.010 | — |
| 2 | 0.011 | 0.53 | 0.32 | 0.32 | 0.03 | 0.002 | 13.7 | 0.30 | 1.54 | 0.04 | — | 0.012 | — |
| 3 | 0.011 | 0.51 | 0.31 | 0.22 | 0.03 | 0.002 | 14.0 | 0.20 | 1.46 | 0.04 | — | 0.011 | — |

TABLE 1-1-continued

| | | | | | | | | | | | | | |
|---|---|---|---|---|---|---|---|---|---|---|---|---|---|
| 4 | 0.010 | 0.51 | 0.29 | 0.88 | 0.03 | 0.002 | 14.3 | 0.20 | 1.49 | 0.06 | — | 0.013 | — |
| 5 | 0.010 | 0.49 | 0.30 | 1.94 | 0.02 | 0.003 | 13.8 | 0.18 | 1.50 | 0.03 | — | 0.012 | — |
| 6 | 0.010 | 0.50 | 0.30 | 2.89 | 0.03 | 0.002 | 14.1 | 0.21 | 1.47 | 0.04 | — | 0.012 | — |
| 7 | 0.004 | 0.48 | 0.25 | 0.33 | 0.03 | 0.002 | 15.3 | 0.30 | 1.77 | 0.03 | — | 0.005 | — |
| 8 | 0.015 | 0.51 | 0.24 | 0.30 | 0.02 | 0.002 | 13.8 | 0.29 | 1.31 | 0.04 | — | 0.016 | — |
| 9 | 0.010 | 0.13 | 0.16 | 0.31 | 0.03 | 0.003 | 16.3 | 0.24 | 1.95 | 0.04 | — | 0.012 | — |
| 10 | 0.009 | 0.30 | 0.28 | 0.34 | 0.03 | 0.002 | 11.8 | 0.26 | 1.16 | 0.05 | — | 0.013 | — |
| 11 | 0.010 | 0.84 | 0.77 | 0.33 | 0.03 | 0.002 | 12.7 | 0.31 | 1.43 | 0.05 | — | 0.011 | — |
| 12 | 0.012 | 0.46 | 0.24 | 0.35 | 0.02 | 0.002 | 10.9 | 0.19 | 1.62 | 0.04 | — | 0.009 | 0.15 |
| 13 | 0.009 | 0.47 | 0.26 | 0.32 | 0.03 | 0.002 | 20.3 | 0.17 | 1.80 | 0.03 | — | 0.012 | — |
| 14 | 0.009 | 0.47 | 0.30 | 0.32 | 0.03 | 0.003 | 14.5 | 0.23 | 1.44 | 0.03 | 0.19 | 0.014 | — |
| 15 | 0.011 | 0.50 | 0.31 | 0.36 | 0.03 | 0.002 | 15.6 | 0.29 | 1.21 | 0.04 | — | 0.012 | — |
| 16 | 0.009 | 0.51 | 0.30 | 0.28 | 0.02 | 0.002 | 13.8 | 0.14 | 0.47 | 0.03 | — | 0.012 | — |
| 17 | 0.009 | 0.48 | 0.30 | 0.32 | 0.03 | 0.002 | 14.2 | 0.14 | 2.61 | 0.05 | — | 0.013 | — |
| 18 | 0.009 | 0.50 | 0.31 | 0.29 | 0.03 | 0.002 | 13.8 | 0.02 | 1.49 | 0.04 | — | 0.013 | — |
| 19 | 0.010 | 0.49 | 0.27 | 0.30 | 0.03 | 0.002 | 14.2 | 1.06 | 1.50 | 0.04 | — | 0.010 | — |
| 20 | 0.009 | 0.50 | 0.29 | 0.03 | 0.03 | 0.002 | 14.1 | 0.19 | 1.47 | 0.03 | — | 0.012 | — |
| 21 | 0.009 | 0.48 | 0.32 | 3.11 | 0.03 | 0.002 | 14.2 | 0.20 | 1.49 | 0.04 | — | 0.012 | — |
| 22 | 0.011 | 0.49 | 0.30 | 0.35 | 0.03 | 0.003 | 15.7 | 0.20 | 1.64 | 0.03 | — | 0.011 | — |
| 23 | 0.012 | 0.47 | 0.32 | 0.33 | 0.03 | 0.002 | 14.9 | 0.32 | 0.89 | 0.05 | — | 0.015 | — |
| 27 | 0.008 | 0.83 | 0.38 | 0.02 | 0.03 | 0.003 | 14.9 | 0.22 | 0.02 | 0.46 | 0.04 | 0.009 | 0 |
| 28 | 0.007 | 0.87 | 0.13 | 0.37 | 0.02 | 0.002 | 15.3 | 0.07 | 0.79 | 0.08 | — | 0.011 | — |
| 29 | 0.008 | 0.92 | 0.16 | 0.56 | 0.02 | 0.002 | 10.9 | 0.08 | 0.98 | 0.11 | — | 0.009 | — |
| 30 | 0.005 | 0.55 | 0.25 | 0.80 | 0.02 | 0.003 | 14.2 | 0.16 | 0.56 | 0.13 | — | 0.008 | — |
| 31 | 0.010 | 1.87 | 0.38 | 0.46 | 0.03 | 0.002 | 16.0 | 0.12 | 1.07 | 0.09 | — | 0.012 | — |
| 32 | 0.009 | 0.69 | 0.22 | 1.48 | 0.02 | 0.001 | 13.4 | 0.10 | 1.26 | 0.07 | 0.14 | 0.009 | — |
| 33 | 0.007 | 0.75 | 0.17 | 0.52 | 0.02 | 0.002 | 18.1 | 0.13 | 0.81 | 0.14 | — | 0.010 | — |
| 34 | 0.006 | 0.88 | 0.14 | 1.89 | 0.03 | 0.002 | 15.8 | 0.09 | 1.63 | 0.04 | — | 0.009 | 0.08 |
| 35 | 0.011 | 0.49 | 0.20 | 0.44 | 0.01 | 0.001 | 19.0 | 0.07 | 1.19 | 0.06 | — | 0.008 | — |
| 36 | 0.008 | 0.22 | 0.15 | 2.46 | 0.02 | 0.003 | 12.6 | 0.11 | 0.92 | 0.10 | — | 0.011 | — |
| 37 | 0.009 | 1.27 | 0.32 | 0.40 | 0.03 | 0.002 | 14.8 | 0.12 | 1.30 | 0.07 | — | 0.009 | — |
| 38 | 0.006 | 0.89 | 0.29 | 0.31 | 0.02 | 0.003 | 17.7 | 0.08 | 0.66 | 0.12 | — | 0.008 | — |
| 39 | 0.007 | 0.14 | 0.14 | 1.94 | 0.01 | 0.001 | 14.9 | 0.11 | 1.21 | 0.09 | — | 0.011 | — |
| 40 | 0.009 | 0.56 | 0.25 | 0.17 | 0.02 | 0.003 | 14.6 | 0.09 | 1.08 | 0.08 | — | 0.009 | — |

| | Chemical Composition (mass %)* | | | | | | | | | Ti/ |
|---|---|---|---|---|---|---|---|---|---|---|
| NO. | Ti | B | Co | Mo | W | REM | Ca | Mg | C + N | (C + N) |
| 1 | 0.24 | 0.0015 | — | 0.03 | 0.02 | — | — | — | 0.020 | 12.0 |
| 2 | 0.26 | 0.0015 | — | 0.01 | 0.03 | — | — | — | 0.023 | 11.3 |
| 3 | 0.23 | 0.0015 | — | 0.03 | 0.02 | — | — | — | 0.022 | 10.5 |
| 4 | 0.24 | 0.0010 | — | 0.02 | 0.02 | — | — | — | 0.023 | 10.4 |
| 5 | 0.23 | 0.0011 | — | 0.04 | 0.01 | — | — | — | 0.022 | 10.5 |
| 6 | 0.25 | 0.0014 | — | 0.02 | 0.03 | 0.02 | — | — | 0.022 | 11.4 |
| 7 | 0.09 | 0.0018 | — | 0.03 | 0.02 | — | — | — | 0.009 | 10.0 |
| 8 | 0.45 | 0.0016 | — | 0.02 | 0.01 | — | — | — | 0.031 | 14.5 |
| 9 | 0.21 | 0.0008 | — | 0.01 | 0.03 | — | — | — | 0.022 | 9.5 |
| 10 | 0.20 | 0.0016 | — | 0.05 | 0.02 | — | — | — | 0.022 | 9.1 |
| 11 | 0.18 | 0.0025 | — | 0.02 | 0.04 | — | — | — | 0.021 | 8.6 |
| 12 | 0.20 | 0.0014 | — | 0.03 | 0.01 | — | — | — | 0.021 | 9.5 |
| 13 | 0.35 | 0.0007 | 0.22 | 0.04 | 0.01 | — | — | — | 0.021 | 16.7 |
| 14 | 0.19 | 0.0013 | — | 0.02 | 0.02 | — | — | — | 0.023 | 8.3 |
| 15 | 0.16 | 0.0045 | — | 0.02 | 0.03 | — | — | — | 0.023 | 7.0 |
| 16 | 0.23 | 0.0016 | — | 0.03 | 0.02 | — | — | — | 0.021 | 11.0 |
| 17 | 0.26 | 0.0013 | — | 0.03 | 0.02 | — | — | — | 0.022 | 11.8 |
| 18 | 0.24 | 0.0014 | — | 0.02 | 0.02 | — | — | — | 0.022 | 10.9 |
| 19 | 0.24 | 0.0006 | — | 0.04 | 0.02 | — | — | — | 0.020 | 12.0 |
| 20 | 0.23 | 0.0013 | — | 0.02 | 0.01 | — | — | — | 0.021 | 11.0 |
| 21 | 0.23 | 0.0009 | — | 0.01 | 0.01 | — | — | — | 0.021 | 11.0 |
| 22 | 0.26 | — | — | 0.02 | 0.01 | — | — | — | 0.022 | 11.8 |
| 23 | 0.13 | 0.0019 | — | 0.01 | 0.01 | — | — | — | 0.027 | 4.8 |
| 27 | 0.01 | 0.0005 | 0.01 | 0.01 | 0.01 | — | — | — | 0.017 | 0.8 |
| 28 | 0.24 | 0.0003 | — | 0.01 | — | — | 0.0007 | 0.0009 | 0.018 | 13.3 |
| 29 | 0.27 | 0.0009 | — | 0.03 | 0.01 | — | 0.0009 | 0.0005 | 0.017 | 15.9 |
| 30 | 0.21 | 0.0005 | — | 0.02 | — | — | 0.0007 | 0.0008 | 0.013 | 16.2 |
| 31 | 0.25 | 0.0014 | — | — | — | — | 0.0010 | 0.0011 | 0.022 | 11.4 |
| 32 | 0.29 | 0.0008 | — | 0.06 | — | — | 0.0009 | 0.0014 | 0.018 | 16.1 |
| 33 | 0.30 | 0.0006 | 0.03 | 0.02 | — | — | 0.0011 | 0.0013 | 0.017 | 17.6 |
| 34 | 0.22 | 0.0012 | — | 0.01 | 0.02 | — | 0.0014 | 0.0007 | 0.015 | 14.7 |
| 35 | 0.34 | 0.0005 | — | 0.05 | — | 0.06 | 0.0008 | 0.0010 | 0.019 | 17.9 |
| 36 | 0.25 | 0.0004 | — | 0.08 | — | — | — | 0.0007 | 0.019 | 13.2 |
| 37 | 0.26 | 0.0009 | — | — | 0.07 | — | 0.0009 | 0.0009 | 0.018 | 14.4 |
| 38 | 0.18 | 0.0018 | — | 0.03 | — | — | 0.0027 | — | 0.014 | 12.9 |
| 39 | 0.39 | 0.0033 | — | 0.04 | — | — | 0.0009 | 0.0008 | 0.018 | 21.7 |
| 40 | 0.20 | 0.0009 | — | 0.01 | — | — | 0.0008 | 0.0011 | 0.018 | 11.1 |

*Under lined value is out of range according to the present invention.

TABLE 1-2

| No. | Thermal Fatigue Life (Cycle Number) | Weight Gain by Oxidation in Cyclic Oxidation Test ($g/m^2$) | Cyclic Oxidation Test** | Cycle Number for Breakage in High Temperature Fatigue Test $\times 10^5$ | Note |
|---|---|---|---|---|---|
| 1 | 990 | 45 | Satisfactory | 19 | Example |
| 2 | 1030 | 43 | Satisfactory | 21 | Example |
| 3 | 1060 | 44 | Satisfactory | 19 | Example |
| 4 | 1070 | 43 | Satisfactory | 24 | Example |
| 5 | 1080 | 36 | Satisfactory | 26 | Example |
| 6 | 1030 | 35 | Satisfactory | 22 | Example |
| 7 | 970 | 45 | Satisfactory | 22 | Example |
| 8 | 980 | 48 | Satisfactory | 19 | Example |
| 9 | 950 | 48 | Satisfactory | 17 | Example |
| 10 | 970 | 46 | Satisfactory | 18 | Example |
| 11 | 1010 | 41 | Satisfactory | 20 | Example |
| 12 | 990 | 48 | Satisfactory | 20 | Example |
| 13 | 970 | 45 | Satisfactory | 22 | Example |
| 14 | 1020 | 44 | Satisfactory | 23 | Example |
| 15 | 980 | 46 | Satisfactory | 20 | Example |
| 16 | 830 | 40 | Satisfactory | 16 | Comparative Example |
| 17 | 850 | 50 | Satisfactory | 20 | Comparative Example |
| 18 | 910 | 113 | Unsatisfactory | 19 | Comparative Example |
| 19 | 940 | 56 | Unsatisfactory | 22 | Comparative Example |
| 20 | 1020 | 45 | Satisfactory | 9 | Comparative Example |
| 21 | 950 | 35 | Satisfactory | 11 | Comparative Example |
| 22 | 870 | 47 | Satisfactory | 19 | Comparative Example |
| 23 | 890 | 52 | Satisfactory | 14 | Comparative Example |
| 27 | 910 | 223 | Unsatisfactory | 15 | Comparative Example Combined Nb—Si Added Steel |
| 28 | 940 | 38 | Satisfactory | 24 | Example |
| 29 | 970 | 46 | Satisfactory | 25 | Example |
| 30 | 920 | 43 | Satisfactory | 25 | Example |
| 31 | 950 | 37 | Satisfactory | 25 | Example |
| 32 | 1000 | 36 | Satisfactory | 26 | Example |
| 33 | 960 | 46 | Satisfactory | 25 | Example |
| 34 | 1050 | 34 | Satisfactory | 27 | Example |
| 35 | 990 | 30 | Satisfactory | 25 | Example |
| 36 | 960 | 37 | Satisfactory | 26 | Example |
| 37 | 980 | 39 | Satisfactory | 25 | Example |
| 38 | 930 | 36 | Satisfactory | 24 | Example |
| 39 | 1040 | 37 | Satisfactory | 27 | Example |
| 40 | 940 | 49 | Satisfactory | 13 | Comparative Example |

**Satisfactory; without Spalling of Scale, Unsatisfactory; with Spelling of Scale
Under lined value is out of range according to the present invention.

It is clearly confirmed from Tables 1-1 and 1-2 that the examples of the present invention all have thermal fatigue resistance, high-temperature fatigue resistance and oxidation resistance equivalent to or more than those of Nb—Si added steel, which means that the object of the present invention is achieved.

The steel according to the present invention can be ideally used not only for the parts of an exhaust system of, for example, an automobile but also for the parts of an exhaust system of a thermal electric power plant and the parts of a solid-oxide fuel cell which are required to have similar properties as the parts of an exhaust system of an automobile.

The invention claimed is:

1. Ferritic stainless steel having a chemical composition containing, by mass %, C: 0.020% or less, Si: 3.0% or less, Mn: 3.0% or less, P: 0.040% or less, S: 0.030% or less, Cr: 10% to 25%, N: 0.020% or less, Nb: 0.005% to 0.15%, Al: 0.3% or more and less than 1.0% , Ti: 5×(C %+N %) to 0.5%, Mo: 0.1% or less, W: 0.1% or less, Cu: 0.55% to 2.0%, B: 0.0002% to 0.0050%, Ni: 0.05% to 1.0%, and the balance being Fe and inevitable impurities, where C % and N % in the expression 5×(C %+N %) respectively represent the contents (mass %) of the chemical elements C and N, wherein the ferritic stainless steel exhibits a weight gain by oxidation of less than 50 $g/m^2$.

2. The ferritic stainless steel according to claim 1, the steel having the chemical composition further containing, by mass %, one or more selected from the group consisting of REM: 0.001% to 0.08%, Zr: 0.01% to 0.5%, V: 0.01% to 0.5%, and Co: 0.01% to 0.5%.

3. The ferritic stainless steel according to claim 1, the steel having the chemical composition further containing, by mass %, one or more selected from the group consisting of Ca: 0.0005% to 0.0030% and Mg: 0.0002% to 0.0020%.

4. The ferritic stainless steel according to claim 2, the steel having the chemical composition further containing, by mass %, one or more selected from the group consisting of Ca: 0.0005% to 0.0030% and Mg: 0.0002% to 0.0020%.

5. The ferritic stainless steel according to claim 1, wherein the steel exhibits a thermal fatigue cycle number for failure of 900 or more.

6. The ferritic stainless steel according to claim 1, wherein the steel exhibits a cycle number for breakage in a high temperature fatigue test of more than $15\times10^5$.

* * * * *